US009244411B2

(12) United States Patent
Seshita et al.

(10) Patent No.: US 9,244,411 B2
(45) Date of Patent: Jan. 26, 2016

(54) FIXING DEVICE AND IMAGE FORMING APPARATUS INCORPORATING SAME

(71) Applicants: Takuya Seshita, Kanagawa (JP); Hiroshi Yoshinaga, Chiba (JP); Takeshi Uchitani, Kanagawa (JP); Yutaka Ikebuchi, Kanagawa (JP); Takamasa Hase, Shizuoka (JP); Shuutaroh Yuasa, Kanagawa (JP)

(72) Inventors: Takuya Seshita, Kanagawa (JP); Hiroshi Yoshinaga, Chiba (JP); Takeshi Uchitani, Kanagawa (JP); Yutaka Ikebuchi, Kanagawa (JP); Takamasa Hase, Shizuoka (JP); Shuutaroh Yuasa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 86 days.

(21) Appl. No.: 13/930,582

(22) Filed: Jun. 28, 2013

(65) Prior Publication Data

US 2014/0016972 A1 Jan. 16, 2014

(30) Foreign Application Priority Data

Jul. 12, 2012 (JP) ..... 2012-156134
May 28, 2013 (JP) ..... 2013-111679

(51) Int. Cl.
*G03G 15/20* (2006.01)

(52) U.S. Cl.
CPC ..... *G03G 15/2064* (2013.01); *G03G 15/2053* (2013.01); *G03G 2215/2035* (2013.01)

(58) Field of Classification Search
CPC ..... G03G 15/2042; G03G 15/2082
USPC ..... 399/328, 329
See application file for complete search history.

(56) References Cited

U.S. PATENT DOCUMENTS

| | | | | |
|---|---|---|---|---|
| 2010/0092220 | A1 | 4/2010 | Hasegawa et al. | |
| 2010/0092221 | A1 * | 4/2010 | Shinshi et al. | |
| 2011/0026988 | A1 * | 2/2011 | Yoshikawa et al. | 399/329 |
| 2012/0121303 | A1 | 5/2012 | Takagi et al. | |
| 2012/0224895 | A1 * | 9/2012 | Baba et al. | 399/329 |

FOREIGN PATENT DOCUMENTS

| | | | |
|---|---|---|---|
| JP | 2009-258203 | | 11/2009 |
| JP | 2010-096782 | | 4/2010 |
| JP | 2010107557 | A * | 5/2010 |
| JP | 2011197019 | A * | 10/2011 |

* cited by examiner

*Primary Examiner* — Walter L Lindsay, Jr.
*Assistant Examiner* — Milton Gonzalez
(74) *Attorney, Agent, or Firm* — Harness, Dickey & Pierce, P.L.C.

(57) ABSTRACT

A fixing device includes a rotatable, endless belt, a stationary heater, a stationary pad, a rotatable pressure member, and a heat conductive member. The rotatable, endless belt is looped into a generally cylindrical configuration. The stationary heater is disposed inside the loop of the belt to radiate heat to the belt. The stationary pad is disposed inside the loop of the belt. The rotatable pressure member is disposed parallel to the stationary pad with the belt interposed between the pressure member and the stationary pad. The pressure member presses against the stationary pad via the belt to form a fixing nip therebetween through which a recording medium passes. The heat conductive member is interposed between the belt and the heater to transfer heat radiated from the heater by conduction therethrough to the belt.

19 Claims, 9 Drawing Sheets

FIXING DEVICE AND IMAGE FORMING APPARATUS INCORPORATING SAME

CROSS-REFERENCE TO RELATED APPLICATIONS

The present patent application claims priority pursuant to 35 U.S.C. §119 from Japanese Patent Applications Nos. 2012-156134 and 2013-111679, filed on Jul. 12, 2012 and May 28, 2013, respectively, each of which is hereby incorporated by reference herein in its entirety.

BACKGROUND

1. Technical Field

The present invention relates to a fixing device and an image forming apparatus incorporating the same, and more particularly, to a fixing device that uses a fixing belt for fixing a toner image, and an image forming apparatus, such as a photocopier, facsimile machine, printer, plotter, or multifunctional machine incorporating several of these features, incorporating such a fixing device.

2. Background Art

Fixing devices are employed in electrophotographic image forming apparatuses, such as a photocopier, facsimile machine, printer, plotter, or multifunctional machine incorporating several of these features, wherein an image formed of toner particles is fixed in place with heat and pressure on a recording medium such as a sheet of paper.

Various types of fixing devices are known in the art. One particular type is a belt-based fixing device employing a rotatable, endless belt that can be heated rapidly and efficiently to a desired operational temperature, which allows for processing a toner image with an extremely short warm-up time and first-print time without causing image defects even at high processing speeds.

For example, one belt-based fixing device has been proposed, including a rotatable, endless fuser belt looped into a generally cylindrical configuration, a stationary pad disposed inside the loop of the belt, and a pressure roller pressing against the stationary pad via the belt to form a fixing nip therebetween. Also included are a tubular belt holder of thermally conductive metal, or heat pipe, disposed inside the loop of the belt to face the inner circumferential surface of the belt except at the fixing nip, a heater disposed inside the heat pipe to radiate heat to the heat pipe, and a reinforcing plate disposed in contact with the stationary pad inside the heat pipe to reinforce the fuser pad.

During operation, the heater radiates heat to the heat pipe, from which heat is imparted to the entire circumference of the fuser belt entrained around the heat pipe. The recording sheet is conveyed through the fixing nip, at which the toner image is fixed in place with heat from the fuser belt melting and fusing toner particles, and pressure between the fuser pad and the pressure roller causing molten toner to set onto the recording sheet.

Another, similar fixing device has also been proposed, which employs a heat shield interposed between the belt and the heater to intercept transmission of heat from the heater to the belt, thereby preventing excessive heating of those portions of the belt which do not contact the recording medium during passage through the fixing nip.

The inventors have recognized that one problem associated with the belt-based fixing device is inefficient, non-uniform heating of the belt, which has its inboard portion (i.e., that portion around the longitudinal center of the belt adapted to contact the recording medium during passage through the fixing nip) and its outboard portion (i.e., that portion around the longitudinal end of the belt adapted to remain away from the recording medium during passage through the fixing nip) subjected to different amounts of heat upon activation of the fixing device.

For example, the outboard portion of the belt can be excessively heated after startup of the fixing device, for example, where the belt is warmed stably and sufficiently to a desired operational temperature during sequential processing of multiple recording media. Moreover, using a heat shield to prevent overheating of the outboard portion of the belt can in turn cause heat to escape from the laterally outward, peripheral part of the inboard portion to the outboard portion of the belt during startup of the fixing device, for example, initially in the morning, where the belt has been cooled to an ambient temperature due to an extended period of deactivation.

Those problems, if not properly addressed, would cause various adverse consequences, which are particularly pronounced in the fast, belt-based fixing device that can process a toner image with an extremely short warm-up time and first-print time.

BRIEF SUMMARY

Exemplary aspects of the present invention are put forward in view of the above-described circumstances, and provide a novel fixing device.

In one exemplary embodiment, the fixing device includes a rotatable, endless belt, a stationary heater, a stationary pad, a rotatable pressure member, and a heat conductive member. The rotatable, endless belt is looped into a generally cylindrical configuration. The stationary heater is disposed inside the loop of the belt to radiate heat to the belt. The stationary pad is disposed inside the loop of the belt. The rotatable pressure member is disposed parallel to the stationary pad with the belt interposed between the pressure member and the stationary pad. The pressure member presses against the stationary pad via the belt to form a fixing nip therebetween through which a recording medium passes. The belt has an inboard portion thereof adapted to contact the recording medium during passage through the fixing nip, and an outboard portion thereof adapted to remain away from the recording medium during passage through the fixing nip. The heat conductive member is interposed between the belt and the heater and facing at least partially the outboard portion of the belt to transfer heat radiated from the heater by conduction therethrough to the belt. At least one of the belt and the heat conductive member is displaceable relative to each other in a radial direction of the belt to change a rate of heat transfer from the heat conductive member to the belt.

Other exemplary aspects of the present invention are put forward in view of the above-described circumstances, and provide an image forming apparatus incorporating the fixing device.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
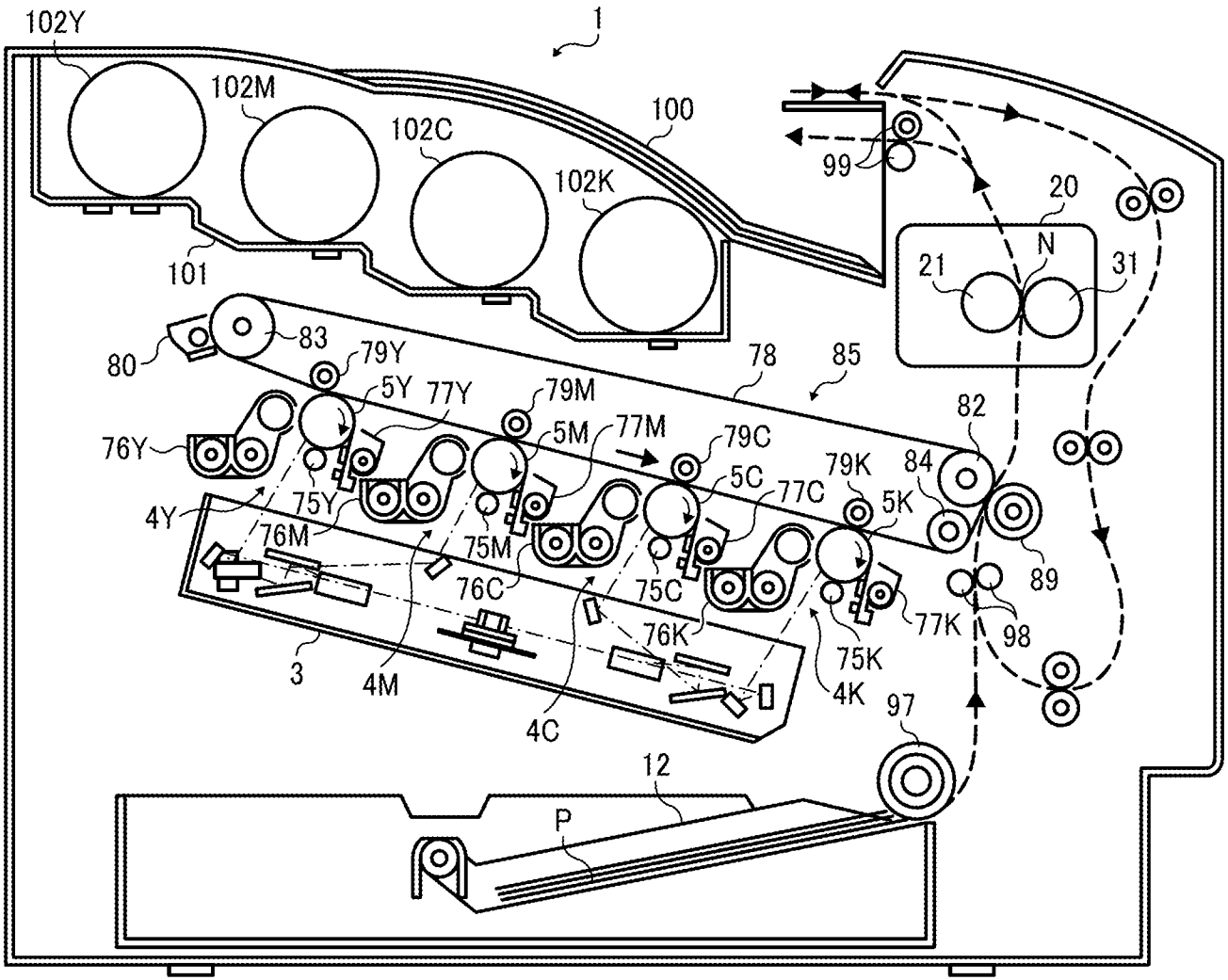
FIG. 1 schematically illustrates an image forming apparatus incorporating a fixing device according to one or more embodiments of this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 schematically illustrates an image forming apparatus 1 incorporating a fixing device 20 according to one or more embodiments of this patent specification.

As shown in FIG. 1, the image forming apparatus 1 is a tandem color printer including four imaging stations 4Y, 4M, 4C, and 4K arranged in series along the length of an intermediate transfer unit 85 and adjacent to an exposure unit 3, which together form an electrophotographic mechanism to form an image with toner particles on a recording medium such as a sheet of paper P, for subsequent processing through the fixing device 20 located above the intermediate transfer unit 85.

The image forming apparatus 1 also includes a feed roller 97, a pair of registration rollers 98, a pair of discharge rollers 99, and other conveyor and guide members together defining a sheet conveyance path, indicated by broken lines in the drawing, along which a recording sheet P advances upward from a bottom sheet tray 12 accommodating a stack of recording sheet P toward the intermediate transfer unit 85 and then through the fixing device 20 to finally reach an output tray 100 situated atop the apparatus body.

In the image forming apparatus 1, each imaging unit (indicated collectively by the reference numeral 4) has a drum-shaped photoconductor 5 surrounded by a charging device 75, a development device 76, a cleaning device 77, and a discharging device, which work in cooperation to form a toner image of a particular primary color, as designated by the suffixes "Y" for yellow, "M" for magenta, "C" for cyan, and "K" for black. The imaging units 4Y, 4M, 4C, and 4K are supplied with toner from detachably attached, replaceable toner bottles 102Y, 102M, 102C, and 102K, respectively, accommodated in a bottle rack 101 in the upper portion of the apparatus body.

The intermediate transfer unit 85 includes an intermediate transfer belt 78, four primary transfer rollers 79Y, 79M, 79C, and 79K, a secondary transfer roller 89, and a belt cleaner 80, as well as a transfer backup roller or drive roller 82, a cleaning backup roller 83, and a tension roller 84 around which the intermediate transfer belt 78 is entrained. When driven by the roller 82, the intermediate transfer belt 78 travels counterclockwise in the drawing along an endless travel path, passing through four primary transfer nips defined between the primary transfer rollers 79 and the corresponding photoconductive drums 5, as well as a secondary transfer nip defined between the transfer backup roller 82 and the secondary transfer roller 89.

The fixing device 20 includes a fuser member 21 and a pressure member 31, one being heated and the other being pressed against the heated one, to form a fixing nip N therebetween in the sheet conveyance path. A detailed description of the fixing device 20 and its associated structure will be given later with reference to FIG. 2 and subsequent drawings.

During operation, each imaging unit 4 rotates the photoconductor drum 5 clockwise in the drawing to forward its outer, photoconductive surface to a series of electrophotographic processes, including charging, exposure, development, transfer, and cleaning, in one rotation of the photoconductor drum 5.

First, the photoconductive surface is uniformly charged by the charging device 75 and subsequently exposed to a modulated laser beam emitted from the exposure unit 3. The laser exposure selectively dissipates the charge on the photoconductive surface to form an electrostatic latent image thereon according to image data representing a particular primary color. Then, the latent image enters the development device 76, which renders the incoming image visible using toner. The toner image thus obtained is forwarded to the primary transfer nip between the intermediate transfer belt 78 and the primary transfer roller 79.

At the primary transfer nip, the primary transfer roller 79 is supplied with a bias voltage of a polarity opposite that of the toner on the photoconductor drum 5. This electrostatically transfers the toner image from the photoconductive surface to an outer surface of the belt 78, with a certain small amount of residual toner particles left on the photoconductive surface. Such transfer process occurs sequentially at the four primary transfer nips along the belt travel path, so that toner images of different colors are superimposed one atop another to form a single multicolor image on the surface of the intermediate transfer belt 78.

After primary transfer, the photoconductive surface enters the cleaning device 77 to remove residual toner by scraping it off with a cleaning blade, and then to the discharging device to remove residual charges for completion of one imaging cycle. At the same time, the intermediate transfer belt 78 forwards the multicolor image to the secondary transfer nip between the transfer backup roller 82 and the secondary transfer roller 89.

Meanwhile, in the sheet conveyance path, the feed roller 97 rotates counterclockwise in the drawing to introduce a recording sheet P from the sheet tray 12 toward the pair of registration rollers 98 being rotated. Upon receiving the fed sheet P, the registration rollers 98 stop rotation to hold the incoming sheet P therebetween, and then advance it in sync with the movement of the intermediate transfer belt 78 to the secondary transfer nip. At the secondary transfer nip, the multicolor image is transferred from the belt 78 to the recording sheet P, with a certain small amount of residual toner particles left on the belt surface.

After secondary transfer, the intermediate transfer belt 78 enters the belt cleaner 80, which removes and collects residual toner from the intermediate transfer belt 78. At the same time, the recording sheet P bearing the powder toner image thereon is introduced into the fixing device 20, which fixes the multicolor image in place on the recording sheet P with heat and pressure through the fixing nip N.

Thereafter, the recording sheet P is ejected by the discharge rollers 99 to the output tray 100 for stacking outside the apparatus body, which completes one operational cycle of the image forming apparatus 1.

Figure 2:
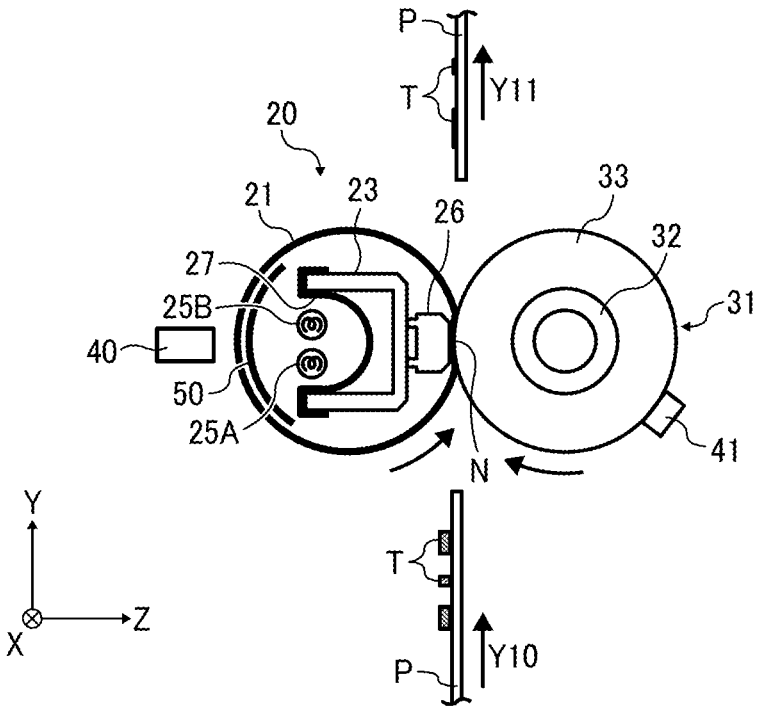
FIG. 2 is an axial end-on view of the fixing device according to one or more embodiments of this patent specification.

FIG. 2 is an axial end-on view of the fixing device 20 according to one or more embodiments of this patent specification.

As shown in FIG. 2, the fixing device 20 includes a rotatable, endless fuser belt 21 looped into a generally cylindrical configuration extending in a longitudinal direction X; a stationary heater 25 disposed inside the loop of the belt 21 to radiate heat to the belt 21; a stationary fuser pad 26 disposed inside the loop of the belt 21; and a rotatable pressure member 31 disposed parallel to the stationary pad 26 with the belt 21 interposed between the pressure member 31 and the stationary pad 26. The pressure member 31 presses against the stationary pad 26 via the belt 21 in a load direction Z to form a fixing nip N therebetween through which a recording medium P passes in a conveyance direction Y.

As used herein, the term "longitudinal direction X" refers to a direction in which the endless looped belt 21 in its generally cylindrical configuration extends laterally across the fixing device 20. The term "conveyance direction Y" refers to a direction perpendicular to the longitudinal direction X in which the recording medium P is conveyed through the fixing nip N. The term "load direction Z" refers to a direction perpendicular to the longitudinal direction X and the conveyance direction Y, in which the pressure member 31 presses against the fuser pad 26 to establish the fixing nip N.

Figure 3A:
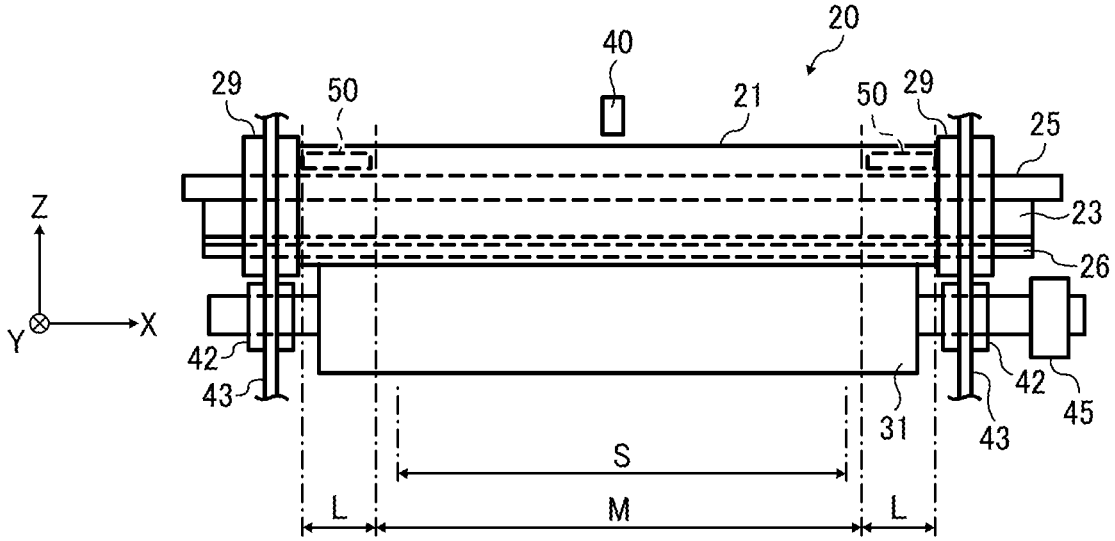
FIGS. 3A and 3B are side-on, lateral views of the fixing device and an internal structure of an endless belt assembly included in the fixing device of FIG. 2, respectively.
Figure 3B:
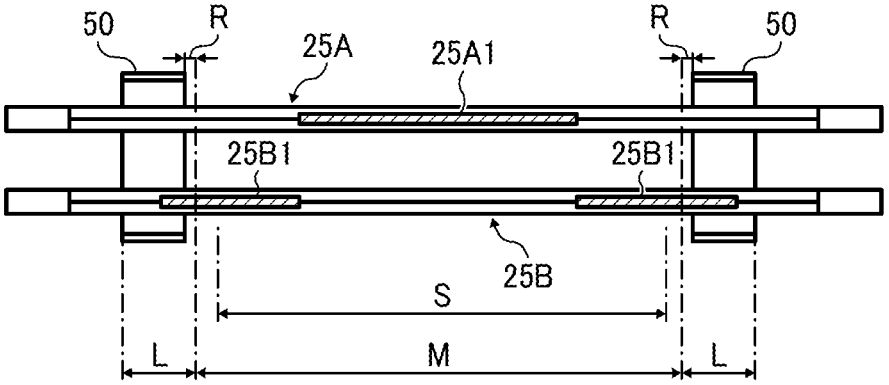

FIGS. 3A and 3B are side-on, lateral views of the fixing device 20 and an internal structure of the endless belt assembly included in the fixing device 20 of FIG. 2, respectively.

As shown in FIGS. 3A and 3B, the belt 21 has an inboard portion M thereof adapted to contact the recording medium P during passage through the fixing nip N, and an outboard portion L thereof adapted to remain away from the recording medium P during passage through the fixing nip N.

As used herein, the term "inboard portion" refers to a generally central portion of the belt 21 indicated by letter "M" in FIGS. 3A and 3B, having a width extending in the longitudinal direction X substantially across a maximum width of the recording medium P accommodated in the image forming apparatus 1, or more specifically, in the fixing device 20. For example, the inboard portion M may have a width of approximately 210 mm in the longitudinal direction X where the maximum width of the recording medium P is that of the short side of A4-size paper.

The term "outboard portion" refers to either of opposed, generally peripheral portions of the belt 21 indicated by letter "L" in FIGS. 3A and 3B, each having a width extending in the longitudinal direction X substantially half the difference between the entire width of the belt 21 and the maximum width of the recording medium P.

The inboard portion M encompasses an entire width of an imaging portion S adapted to face a toner image formed on the recording medium P during passage through the fixing nip N. The imaging portion S may have its lateral edge displaced laterally, for example, approximately 2 mm inward from an adjacent edge of the inboard portion M.

With continued reference to FIGS. 2, 3A and 3B, the fixing device 20 is shown further including a heat conductive member 50 interposed between the belt 21 and the heater 25 and facing at least partially the outboard portion L of the belt 21 to transfer heat radiated from the heater 25 by conduction therethrough to the belt 21. Specific configuration of the heat conductive member 50 and its associated structure will be described in more detail with reference to FIGS. 12A and 12B and subsequent drawings.

The fixing device 20 also includes a stationary reinforcing member 23 disposed in contact with the stationary pad 26 inside the loop of the belt 21 to reinforce the stationary pad 26 against pressure from the pressure member 31, a reflector 27 interposed between the heater 25 and the reinforcing member 23 to reflect radiation from the heater 25, and a pair of mounting flanges 29 connected to a pair of opposed lateral ends of the belt 21 to retain the belt 21 in shape. Also included are a first temperature sensor 40 disposed facing the belt 21 to detect temperature at the belt surface, and a second temperature sensor 41 disposed facing the pressure member 31 to detect temperature at the roller surface.

A pair of parallel sidewalls 43 forms an enclosure in which the fixing device 20 is accommodated. Elongated components of the fixing device 20, such as, for example, the fuser belt 21, the fuser pad 26, the reinforcing member 23, the heater 25, and the pressure member 31, extend generally in parallel with each other and have their respective longitudinal ends supported on the sidewalls 43 either directly or indirectly.

Figure 4:
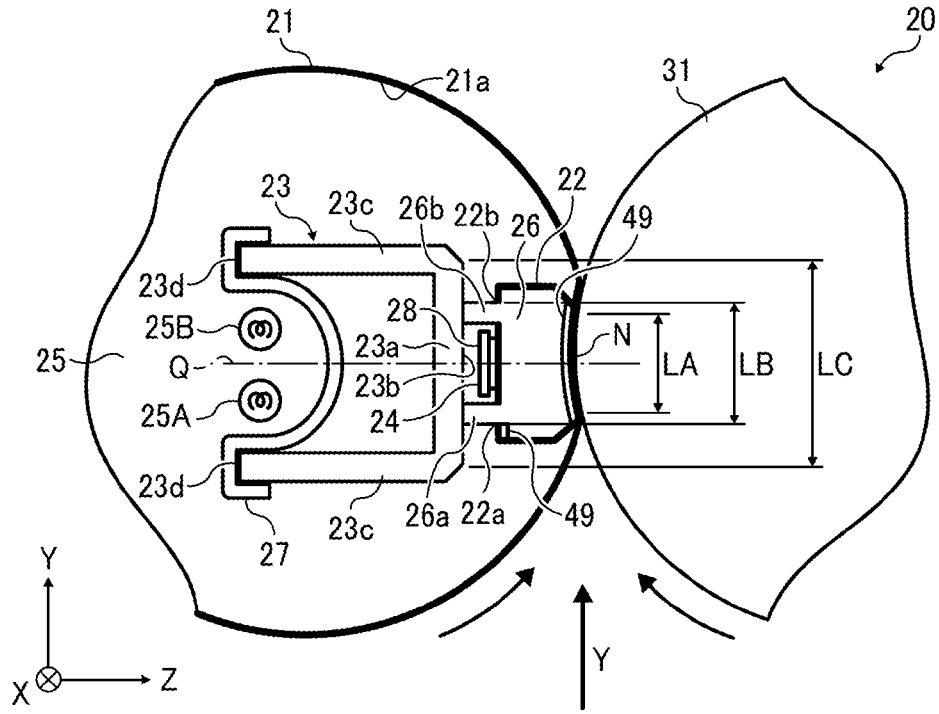
FIG. 4 is an enlarged axial end-on view of the fixing device of FIG. 2.

With additional reference to FIG. 4, which is an enlarged axial end-on view of the fixing device 20 of FIG. 2, the fixing device 20 is shown further including a low-friction sheet 22 of lubricant-impregnated material covering the stationary fuser pad 26 to supply lubricant between the fuser pad 26 and the belt 21 across the fixing nip N, one or more screws 24 to fasten the low-friction sheet 22 onto the fuser pad 26, and a securing plate 28 disposed where the low-friction sheet 22 is screwed to secure the sheet 22 in place on the fuser pad 26.

Components inside the loop of the fuser belt 21, including the stationary fuser pad 26, the low-friction sheet 22, the screws 24, and the securing plate 28, as well as the reinforcing member 23, the stationary heater 25, and the reflector 27, are all stationarily disposed inside the loop of the fuser belt 21.

As used herein, the term "stationary" or "stationarily disposed" is used to describe a state in which a component remains immobile and does not move or rotate during operation of the fixing device. A stationary member may still be subjected to external mechanical force and pressure resulting from its intended use (e.g., the stationary fuser pad pressed against the pressure member by a spring or biasing member), but only to an extent that does not cause substantial movement, rotation, or displacement of the stationary member.

During operation, upon activation of the image forming apparatus 1, power supply circuitry starts supplying power to the heater 25, which then radiates heat to the entire surface of the belt 21 except at the fixing nip N. Operation of the heater 25 is electrically controlled, for example, through on-off control according to readings of the temperature sensor 40 to adjust the belt temperature to a desired fixing temperature.

Meanwhile, a rotary drive motor activates the pressure member 31 to rotate clockwise in the drawing, which in turn rotates the fuser belt 21 counterclockwise in the drawing due to friction between the belt 21 and the pressure member 31.

Then, a recording sheet P bearing an unfixed, powder toner image, which has been transferred through the secondary transfer nip, enters the fixing device 20 while guided along a suitable guide mechanism in the conveyance direction Y10.

As the fuser belt 21 and the pressure member 31 rotate together, the recording sheet P advances through the fixing nip N to fix the toner image in place, wherein heat from the fuser belt 21 causes the toner particles to fuse and melt, while pressure between the fuser pad 26 and the pressure member 31 causes the molten toner to set onto the recording sheet P. Upon exiting the fixing nip N, the recording sheet P is forwarded to a subsequent destination in the conveyance direction Y11.

Specifically, in the present embodiment, the rotatable, endless fuser belt 21 comprises a flexible belt constructed of an inner, thermally conductive substrate defining an inner circumferential surface 21*a* (i.e., the surface that faces the fuser pad 26 inside the loop) of the belt 21, an intermediate elastic layer disposed on the substrate, and an outer release layer disposed on the intermediate elastic layer, which together form a multilayered structure with a thickness of approximately 1 mm or thinner.

The belt 21 is looped into a generally cylindrical configuration, approximately 15 mm to approximately 120 mm in diameter. In the present embodiment, the fuser belt 21 is a multilayered endless belt having an inner diameter of approximately 25 mm and an axial length of approximately 270 mm in its looped, generally cylindrical configuration More specifically, the substrate of the belt 21 may be formed of thermally conductive material, approximately 30 μm to approximately 50 μm thick, including nickel, stainless, or any suitable metal, as well as synthetic resin such as polyimide (PI).

The intermediate elastic layer of the belt 21 may be a deposit of rubber, such as solid or foamed silicone rubber, fluorine resin, or the like, approximately 100 μm to approximately 300 μm thick on the substrate. The intermediate elastic layer serves to accommodate minute variations in applied pressure to maintain smoothness of the belt surface at the fixing nip N, which ensures uniform distribution of heat across the recording sheet P to yield a resulting print with a smooth, consistent appearance without artifacts, such as an orange peel-like texture.

The outer release layer of the belt 21 may be a deposit of a release agent, such as tetra fluoro ethylene-perfluoro alkylvinyl ether copolymer or PFA, polytetrafluoroethylene (PTFE), polyimide (PI), polyetherimide (PEI), polyethersulfide (PES), or the like, approximately 5 to 50 μm in thickness on the elastic layer. The release layer provides good stripping of toner from the belt surface to ensure the recording sheet P is properly conveyed through the fixing nip N.

Figure 5:
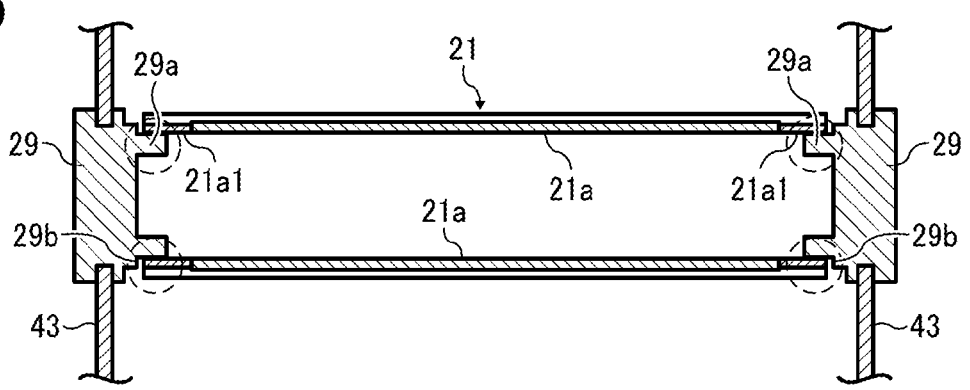
FIG. 5 is a lateral cross-sectional view of the endless belt assembly included in the fixing device of FIG. 2.

With additional reference to FIG. 5, which is a lateral cross-sectional view of the endless belt assembly included in the fixing device 20 of FIG. 2, the fuser belt 21 is shown having its opposed longitudinal ends rotatably supported on the pair of retaining flanges 29 mounted to the sidewalls 43.

The pair of retaining flanges 29 each comprises a piece of suitable material, such as heat-resistant plastic, shaped to engage the sidewall 43. Each retaining flange 29 has a generally circular guide edge 29*a* around which the longitudinal end of the belt 21 is seated to keep the belt 21 in shape and position, and a recessed stopper edge 29*b* around the guide edge 29*a* facing the longitudinal end of the belt 21 to restrict lateral displacement or walk of the belt 21 in the longitudinal direction X thereof.

A pair of low-friction surfaces 21*a*1 may be provided on those portions of the belt 21 which slide along the guide edge 29*a* as the belt 21 rotates. Such low-friction surface 21*a*1 may be formed, for example, by depositing a coating of lubricant, such as fluorine resin or the like, on selected portions of the substrate of the belt 21, as indicated by dotted circles in FIG. 5. Provision of the low-friction surfaces 21*a*1 protects the fuser belt 21 and the guide edges 29*a* of the flange 29 against abrasion or deterioration due to sliding contact between the belt 21 and the guide edges 29*a* during rotation of the belt 21.

Optionally, to prevent damage from excessive abrasion between the longitudinal end of the belt 21 and the retaining flange 29, an annular slip ring, separate from the flange 29, may be provided around the stopper edge 29*b* of the flange 29. Such slip ring may be formed of a suitable low-friction, heat resistant material, such as polyether ether ketone (PEEK), polyphenylene sulfide (PPS), polyamide-imide (PAI), PTFE, or the like, which exhibits a sufficiently low coefficient of friction with respect to the belt material.

The belt 21 is spaced apart from its adjacent, internal structure, such as the reinforcing member 23 and the reflector 27, disposed inside the loop of the belt 21. To prevent interference between the fuser belt 21 and the adjacent structure even where the flexible belt 21 deforms at its longitudinal center during rotation, spacing between the belt 21 and each adjacent structure may be dimensioned depending on rigidity of the belt material. For example, a lower limit of such spacing may be set to approximately 0.02 mm where the belt material is relatively rigid and to approximately 3 mm where the belt material is relatively soft.

With the retaining flanges 29 along which the inner circumferential surface of the belt 21 is guided during rotation, the fuser belt 21 can effectively maintain its looped, generally cylindrical configuration. Thus, the fuser belt 21 does not necessitate any guide structure, such as a tubular holder of thermally conductive metal, or heat pipe, except for the retaining flanges 29 retaining the belt 21 in shape at the longitudinal ends thereof, and the fuser pad 26 contacting the belt 21 along the fixing nip N. The omission of the heat pipe from the fuser belt assembly allows heat from the heater 25 to directly reach the belt 21, leading to good thermal efficiency and reduced size and cost of the fixing process.

The stationary heater 25 comprises a pair of first and second radiant heaters 25A and 25B, such as infrared, halogen heaters, disposed inside the loop of the belt 21, each having a pair of longitudinal ends thereof secured to the sidewalls 43 of the fixing device 20.

With specific reference to FIG. 3B, the pair of first and second radiant heaters 25A and 25B is shown each incorporating an independent heating element located facing a specific portion of the fuser belt 21, such that the independent heating elements together encompass the entire inboard portion M and part of the outboard portion L in the longitudinal direction X of the belt 21.

More specifically, the first heater 25A comprises an elongated heater having a single light-emitting element 25A1 located facing a laterally inward, central part of the inboard portion M of the belt 21. The second heater 25B comprises an elongated heater having a pair of light-emitting elements 25B1, each located facing a laterally outward, peripheral part of the inboard portion M (that is, the inboard portion M except where faced with the light-emitting element 25A1) and a laterally inward part of the outboard portion L contiguous with the inboard portion M of the belt 21.

The length of the light-emitting element 25A1 in the longitudinal direction X does not exceed the maximum width of the recording medium P, whereas the distance between the farthest lateral edges of the light-emitting elements 25B1 exceeds the maximum width of the recording medium P. For example, where the maximum width of the recording medium P is approximately 210 mm, the light-emitting element 25A1 may extend approximately 148 mm (which corresponds to the length of the short side of A5-size paper) in the longitudinal direction X, in which case the light-emitting elements 25B1 may extend at least approximately 32 mm in the longitudinal direction X.

A suitable control circuit, such as an on-off controller, is operatively connected to the first and second heaters 25A and 25B, as well as to the first temperature sensor 40. The fist temperature sensor 40 comprises a suitable thermometer, such as a thermopile, disposed adjacent to the outer circumferential surface of the belt 21 to measure temperature at the belt surface.

The control circuit controls operation of the heaters 25A and 25B according to readings of the temperature sensor 40, while selectively activating a particular heating element or combination of heating elements depending on the size of the recording sheet P being conveyed through the fixing nip N.

For example, where an A4-size paper sheet P enters the fixing nip N, the heater control circuit supplies power to both of the first and second heaters 25A and 25B to heat the entire inboard portion M of the belt 21. Conversely, where an A5-size paper sheet P enters the fixing nip N, the heater control circuit supplies power solely to the first heater 25A to heat the laterally inward, central part of the inboard portion M, leaving the laterally outward portions of the belt 21 unheated.

In the present embodiment, a single temperature sensor 40 is directed to the inboard portion M of the belt 21 (e.g., at the longitudinal center of the belt 21) to measure temperature where the belt 21 is heated primarily by the first heater 25A. In such cases, readings of the temperature sensor 40 may be output to the heater control circuit, which then controls the heaters 25A and 25B based on the output from the temperature sensor 40 directed to the inboard portion M.

Alternatively, instead, two temperature sensors 40 may be provided, one directed to the inboard portion M and the other directed to the outboard portion L of the belt 21, to measure temperature not only where the belt 21 is heated primarily by the first heater 25A but also where the belt 21 is heated primarily by the second heater 25B. In such cases, readings of these temperature sensors 40 may be output to the heater control circuit, which then controls the first heater 25A based on the output from the temperature sensor 40 directed to the inboard portion M, and the second heater 25B based on the output from the temperature sensor 40 directed to the outboard portion L.

Selective activation of the independent heating elements depending on the size of the recording sheet P effectively prevents excessive heating of the outboard portion L of the belt 21, which, compared to the inboard portion M, tends to accumulate greater amounts of heat as there is substantially no constant flow of heat from the outboard portion L to surrounding structures.

Although two heaters 25A and 25B are described in the present embodiment, the number of heaters for heating the belt 21 may be configured otherwise than disclosed herein, and the fixing device 20 may be configured with a single heater, or two or more heaters disposed inside the loop of the belt 21.

Heating the belt 21 from inside the belt loop allows for an energy-efficient, fast compact fixing process that can print with an extremely short warm-up time and first-print time without requiring a complicated or expensive heating assembly. That is, compared to radiation directed to a local, limited area of the belt, radiation from the heaters 25A and 25B can simultaneously reach a relatively large area along the circumference of the belt 21, resulting in a sufficient amount of heat imparted to the belt 21 to prevent image defects even at high processing speeds. In particular, direct radiant heating of the belt 21 with the heaters 25A and 25B allows for good energy efficiency, leading to a compact, inexpensive configuration of the belt-based fixing device.

The stationary fuser pad 26 comprises an elongated piece of sufficiently rigid material having its opposed longitudinal ends supported on the pair of retaining flanges 29 mounted to the sidewalls 43. Examples of suitable material for the fuser pad 26 include metal or resin, in particular, heat-resistant, thermally insulative resin, such as liquid crystal polymer (LCP), PAI, polyethersulfone (PES), PPS, polyether nitrile (PEN), PEEK, or the like, which does not substantially bend or deform under pressure from the pressure member 31 during operation. In the present embodiment, the fuser pad 26 is formed of LCP.

The fuser pad 26 has a smooth, slidable contact surface defined on its front side to face the pressure member 31. In this embodiment, the slidable contact surface of the fuser pad 26 is slightly concave with a curvature similar to that of the circumference of the pressure member 31. Such a configuration allows the contact surface to conform readily to the circumferential surface of the pressure member 31, which prevents the recording sheet P from adhering to or winding around the fuser belt 21 upon exiting the fixing nip N, leading to reliable conveyance of the recording sheet P after fixing process.

Alternatively, instead of the curved configuration, the slidable contact surface of the fuser pad 26 may be substantially flat. Such a flat contact surface remains parallel to the recording sheet P entering the fixing nip N, causing the printed surface of the sheet P to remain flat and thus closely contact the fuser belt 21, leading to good fixing performance through the fixing nip N. Flattening the contact surface also facilitates ready stripping of the recording sheet P from the fuser belt 21, as it causes the flexible belt 21 to exhibit a curvature larger at the exit of the fixing nip N than within the fixing nip N.

The reinforcing member 23 comprises a rectangular U-shaped beam having a central wall 23*a* to contact the stationary pad 26, and a pair of opposed parallel upstanding walls 23*c* each extending from the central wall 23*a* to form a space therebetween in which the heater 25 is accommodated while isolated from the reinforcing member 23 by the reflector 27. The reinforcing member 23 is disposed stationarily inside the loop of the belt 21, with a flat, bearing surface 23*b* of the central wall 23*a* in contact with the fuser pad 26, and a free, distal edge 23*d* of the upstanding wall 23*c* pointing away from the stationary pad 26.

More specifically, in the present embodiment, the reinforcing member 23 comprises a rectangular U-shaped beam formed of a bent plate of suitable material, approximately 2 mm thick, having a length substantially identical to that of the fuser pad 26 (that is, approximately 270 mm in the present example). The reinforcing member 23 supports the fuser pad 26 against pressure from the pressure member 31 transmitted via the fuser belt 21, thereby protecting the fuser pad 26 from substantial bowing or deformation due to nip pressure. For providing sufficient reinforcement, the reinforcing member 23 may be formed of mechanically strong metal, such as stainless steel, iron, or the like.

Figure 6:
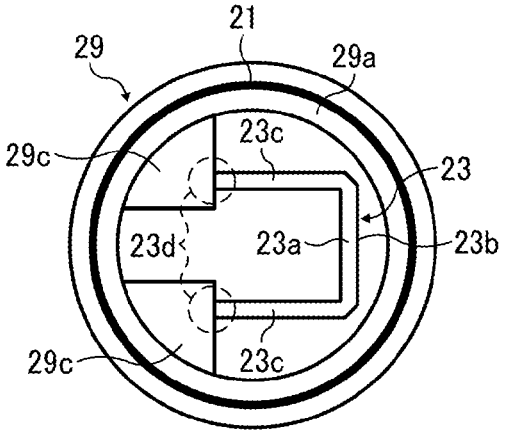
FIG. 6 is an end-on, axial view of the endless belt assembly included in the fixing device of FIG. 2.

With additional reference to FIG. 6, which is an end-on, axial view of the endless belt assembly included in the fixing device 20 of FIG. 2, the reinforcing member 23 is shown with the distal edges 23*d* of the upstanding walls 23*c* each seated on ribs 29*c* of the retaining flange 29. Alternatively, instead of the distal edges 23*d* contacting the ribs 29*c*, the reinforcing member 23 may be positioned through direct contact with the sidewalls 43 of the fixing device 20.

The reflector 27 comprises a plate of reflective material disposed stationarily on that side of the reinforcing member 23 facing the heater 25. Examples of suitable material for the reflector 27 include aluminum, stainless steel, and the like, formed into a suitable configuration to engage the upstanding walls 23*c* of the reinforcing member 23, Provision of the reflective surface on the reinforcing member 23 allows for a high efficiency in heating the belt 21 with the radiant heater 25, as it directs incoming radiation from the heater 25 toward the inner circumferential surface 21*a* of the belt 21 instead of the reinforcing member 23, resulting in an increased amount of heat absorbed in the belt 21.

Alternatively, instead of providing a reflective element separate from the reinforcing member 23, the reinforcing member 23 may be treated with mirror polish or insulation coating, either partially or entirely, to prevent heat from being absorbed in the reinforcing member 23, which in turn allows for increased absorption of heat into the belt 21.

As mentioned earlier, the fixing device 20 in the present embodiment employs a radiant heater disposed inside the loop of the fuser belt 21 to radiate heat to a relatively large area of the inner circumferential surface 21*a* of the belt 21. Such radiant heating of the belt distributes heat along the entire circumference of the belt 21 even where the belt 21 does not rotate. With the belt 21 thus heated thoroughly and uniformly during standby, the fixing device 20 can immediately process an incoming print job upon recovery from standby.

One problem encountered by a conventional on-demand fixing device is that radiant heating the fuser belt can cause an excessive amount of heat accumulating in the pressure roller during standby. Depending on the material of the pressure roller, typically a rubber-based cylinder, intense heating of the pressure roller results in accelerated aging of the pressure roller due to thermal degradation, or more seriously, compression set of rubber under nip pressure, that is, permanent deformation of the rubber-based roller away from the fuser pad, which is aggravated by heat at the fixing nip. Such permanent deformation of the pressure roller translates into variations in size and strength of the fixing nip, which would adversely affect fixing performance, or cause abnormal noise during rotation of the fixing members.

To address these and other problems, in the present embodiment, the reinforcing member 23, combined with the reflector 27, is positioned between the fuser pad 26 and the heater 25 to isolate the fuser pad 26 from radiation from the heater 25 inside the loop of the fuser belt 21.

Specifically, isolating the fuser pad 26 from heat radiation in turn protects the pressure member 31 against excessive heating, which would otherwise cause the pressure member 31 to develop permanent deformation at the fixing nip N where the rubber-based roller is subjected to pressure and heat during standby.

In addition, isolating the fuser pad 26 from heat radiation also isolates lubricant between the fuser pad 26 and the fuser belt 21 against continuous, intense heating, which would otherwise cause lubricant to degrade due to heat combined with high pressure at the fixing nip N, leading to slip or other disturbed movement of the belt along the fuser pad.

Moreover, isolating the fuser pad 26 from heat radiation prevents an excessive amount of heat from being applied to the fuser belt 21 at the fixing nip N, resulting in immediate cooling of the recording sheet P upon exiting the fixing nip N. As the recording sheet P cools, the toner image on the recording sheet P becomes less viscous and less adhesive to the fuser belt 21 at the exit of the fixing nip N. Reduced adhesion of the toner image to the fuser belt 21 allows the recording sheet P to readily separate from the fuser belt 21 without winding around or jamming the fixing nip N, while preventing built-up of toner residues on the surface of the fuser belt 21.

With specific reference to FIG. 4, the fixing device 20 is shown including the low-friction sheet 22 of lubricant-impregnated material covering the stationary pad 26 to supply lubricant between the stationary pad 26 and the belt 21 across the nip N.

During operation, the low-friction sheet 22 retains a constant, continuous supply of lubricant between the adjacent surfaces of the fuser pad 26 and the fuser belt 21, which protects the fuser pad 26 and the belt 21 against wear and tear due to abrasive, frictional contact between the pad and belt surfaces.

The material of the low-friction sheet 22 may be a web of fluorine resin, such as PTFE. The thickness of the low-friction sheet 22 may fall in a range from approximately 150 to approximately 500 μm. The low-friction sheet 22 may be impregnated with a lubricating agent, such as silicone oil, which exhibits a kinematic viscosity ranging from approximately 50 to approximately 1,000 centistokes (cSt).

Use of resin-based woven material promotes retention of lubricant in the lubrication sheet 22 as it provides a porous, fibrous structure within which the lubricating agent may be stably accommodated. Moreover, should the lubrication sheet 22 be depleted of lubricant, the low-friction, fluorine resin material does not cause a substantial frictional resistance at the interface between the fuser pad 26 and the fuser belt 21.

The low-friction sheet 22 may be bonded to selected portions of the fuser pad 26, including, for example, a front side defining the fixing nip N and an edge or surface positioned upstream relative to a center of the fixing nip N in the conveyance direction Y (that is, the lower portion of the fuser pad in FIG. 4). Bonding the low-friction sheet 22 may be accomplished, for example, using a double-sided adhesive tape 49 extending across a length of the sheet 22 in the longitudinal direction X. Such arrangement securely prevents the low-friction sheet 22 from separating from the fuser pad 26 as the fuser pad 26 rotates from downstream to upstream in the circumferential direction thereof during operation.

With continued reference to FIG. 4, the low-friction sheet 22 in the present embodiment is shown wrapping around the stationary pad 26, such that the low-friction sheet 22 covers an entire surface of the fuser pad 26 except where the pad 26 contacts the reinforcing member 23.

Specifically, in the present embodiment, the stationary fuser pad 26 includes one or more contact portions 26*a* and 26*b* spaced apart from each other in the conveyance direction Y, each generally extending in the longitudinal direction X of the belt 21 and protruding toward the reinforcing member 23 to contact the reinforcing member 23. The low-friction sheet 22 has at least one perforation 22*a* and 22*b* defined therein through which the contact portions 26*a* and 26*b* are inserted to allow close fitting between the low-friction sheet 22 and the stationary pad 26 except at the contact portions 26*a* and 26*b*.

More specifically, in the present embodiment, the stationary pad 26 includes a pair of contact portions 26*a* and 26*b*, one positioned upstream and the other downstream from a center of the stationary pad 26 in the conveyance direction Y. Each of the upstream and downstream contact portions 26*a* and 26*b* defines a generally flat contact surface to establish surface contact with the bearing surface 23*b* of the reinforcing member 23.

Provision of the mutually spaced contact portions 26*a* and 26*b* allows for stable positioning of the stationary fuser pad 26 even where the fuser pad 26 is not equipped with a solid, sturdy retaining structure, such as one implemented in a tubular belt holder or heat pipe that has a longitudinal side slot for accommodating the fuser pad therein.

Consider a configuration in which the fuser pad has substantially no retaining structure, while provided with only a single contact portion to contact the reinforcing member. In general, such a contact portion is dimensioned substantially narrower than the width of the pad in the conveyance direction, or otherwise, is offset from the center of the pad in the conveyance direction. In such cases, without any retaining structure, the fuser pad is susceptible to displacement from its proper operational position where pressure from the pressure roller forces the fuser pad to tilt or pivot about the contact portion, resulting in dimensional variations in the fixing nip and concomitant failures, such as defective fixing performance and faulty conveyance of recording media through the fixing nip.

By contrast, the fuser pad 26 in the present embodiment can remain stable and secure in position. That is, the fuser pad 26 does not tilt or pivot around each contact portion even when subjected to nip pressure, since the multiple mutually spaced contact portions 26*a* and 26*b*, encompassing a relatively large area across the fuser pad 26 in the conveyance direction Y, promotes even, uniform contact between the fuser pad 26 and the reinforcing member 23 while effectively dispersing external forces acting on the fuser pad 26 during operation. Well-balanced positioning of the fuser pad 26 may be obtained particularly where the pair of contact portions 26*a* and 26*b* is provided, one positioned upstream and the other downstream from a center of the stationary pad 26 in the conveyance direction Y, as is the case with the present embodiment.

Moreover, provision of the mutually spaced contact portions 26*a* and 26*b* allows for high thermal efficiency in the fuser assembly, as it can reduce a total area of contact between the fuser pad 26 and the reinforcing member 23, compared to that necessary where the fuser pad has a single continuous contact surface to contact the reinforcing member. A reduction in the contact area between the fuser pad 26 and the reinforcing member 23 translates into a reduced amount of heat escaping from the fuser belt 21 to the reinforcing member 23 via the fuser pad 26, leading to increased thermal efficiency in the fuser assembly. This is particularly true where the fuser belt 21 readily loses substantial heat through conduction to the fuser pad 26, for example, due to the fuser belt 21 being of a relatively thin substrate (such as one with a thickness on the order of 160 μm or less), or due to the fixing nip N having a relatively large width in the conveyance direction Y.

Figure 7A:
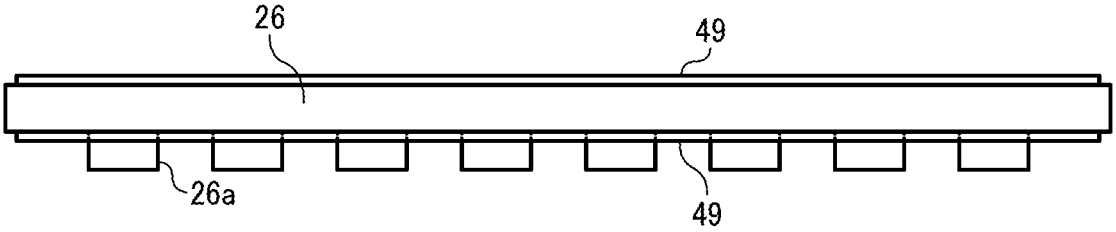
FIGS. 7A, 7B, and 7C are side-elevation, rear-plan, and front-plan views, respectively, of a stationary pad before assembly into the fixing device of FIG. 2.
Figure 7B:
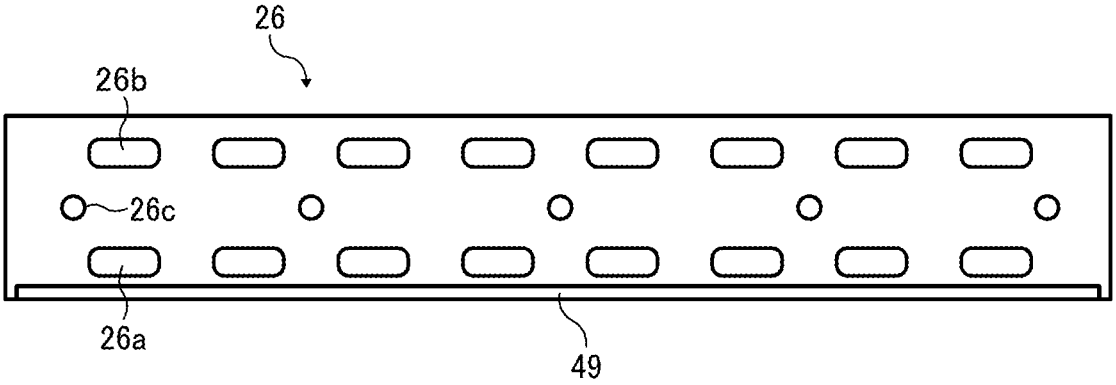
Figure 7C:
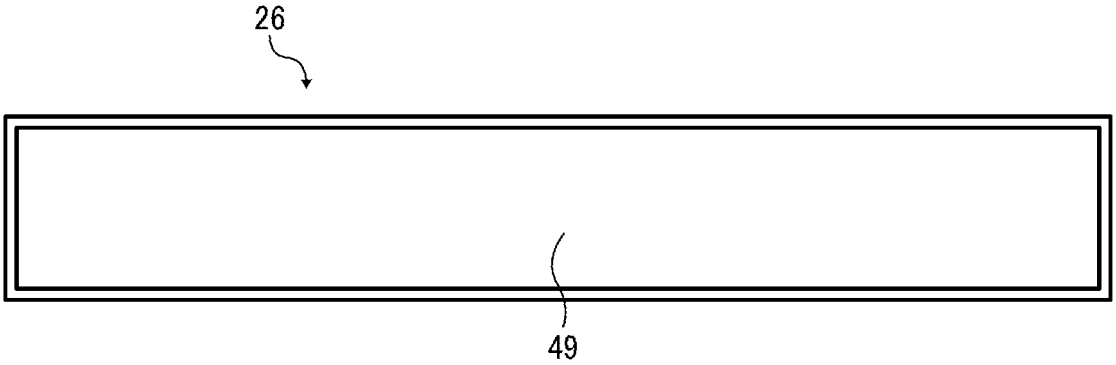

FIGS. 7A, 7B, and 7C are side-elevation, rear-plan, and front-plan views, respectively, of the stationary pad 26 before assembly into the fixing device 20 of FIG. 2.

As shown in FIGS. 7A and 7B, each of the contact portions 26*a* and 26*b* of the fuser pad 26 includes a series of mutually spaced protrusions arranged in the longitudinal direction X of the belt 21.

Specifically, in the present embodiment, each of the upstream and downstream contact portions 26*a* and 26*b* includes a plurality of (in this case, eight) protrusions in series, each evenly spaced from each other in the longitudinal direction X while aligned with a corresponding one of the protrusions on the other side of the fuser pad 26. Compared to providing each contact portion in a single, elongated continuous shape, provision of the series of mutually spaced protrusions results in a reduced area of contact between the fuser pad 26 and the reinforcing member 23, leading to higher thermal efficiency in the fuser assembly.

Although in the present embodiment, the fuser pad 26 is depicted as including two series of mutually spaced protrusions to contact the reinforcing member 23, the contact portions 26*a* and 26*b* may be configured otherwise than those depicted herein. For example, instead of a flat contact surface, the contact portion may define a linear contact edge or a pointed contact end to establish line or point contact (or any such similar contact) with the bearing surface 23*b* of the reinforcing member 23. Further, the number of contact portions 26*a* and 26*b* is not limited to two, and three or more contact portions 26*a* and 26*b* spaced apart from each other in the conveyance direction Y may be provided depending on specific applications.

With still continued reference to FIG. 4, the stationary fuser pad 26 is shown being symmetrical in cross section with respect to an imaginary plane Q perpendicular to the conveyance direction Y and passing through a center of the fuser pad 26 in the conveyance direction Y, as indicated by a broken line in FIG. 4.

Symmetrical configuration of the fuser pad 26 allows for increased balance and stability in position of the fuser pad 26, leading to higher protection against displacement of the fuser pad 26 and concomitant adverse effects on fixing and media conveyance performance of the fixing device.

Further, in the conveyance direction Y, the contact portions 26*a* and 26*b* of the fuser pad 26 are dimensioned with respect to the adjacent structure of the fuser assembly to satisfy the following inequality:

$$LA<LB<LC \qquad \text{Equation I}$$

where "LA" indicates a length or distance between two furthest edges of the fixing nip N in the conveyance direction Y, "LB" indicates a length or distance between two furthest edges of the upstream and downstream contact portions 26*a* and 26*b* in the conveyance direction Y, and "LC" indicates a length or distance between two furthest edges of the bearing surface 23*b* in the conveyance direction Y.

Furthermore, in the conveyance direction Y, the two furthest edges of the fixing nip N both exist between the two furthest edges of the contact portions 26*a* and 26*b*, both of which in turn exist between the two furthest edges of the bearing surface 23*b* of the reinforcing member 23. Thus, in the conveyance direction Y, the dimension of the fixing nip N is encompassed by that of the multiple, mutually spaced contact portions 26*a* and 26*b*, which is in turn covered by the dimension of the bearing surface 23*b* of the reinforcing member 23.

Such dimensioning of the contact portions 26*a* and 26*b* with respect to the adjacent structure of the fuser assembly allows for increased balance and stability in position of the fuser pad 26, leading to higher protection against displacement of the fuser pad 26 and concomitant adverse effects on fixing and media conveyance performance of the fixing device.

Figure 8:
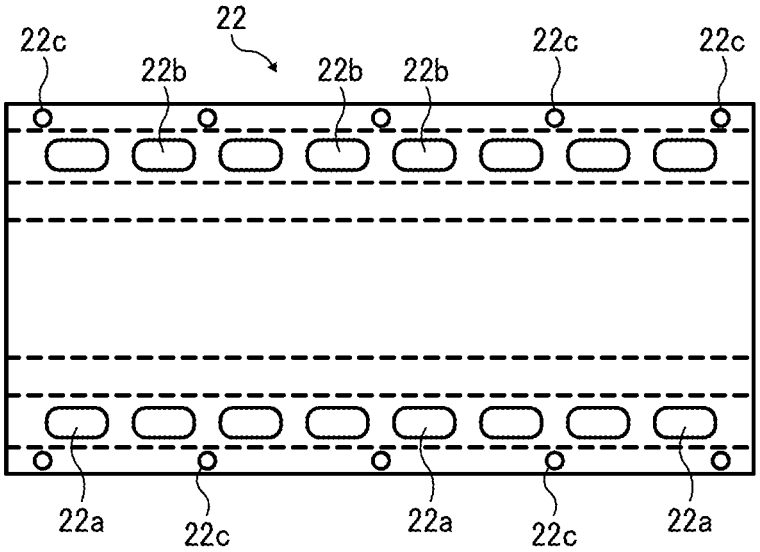
FIG. 8 is a plan view of a low-friction sheet in its unfolded, disassembled state before assembly into the fixing device of FIG. 2.

FIG. 8 is a plan view of the low-friction sheet 22 in its unfolded, disassembled state before assembly into the fixing device 20 of FIG. 2.

As shown in FIG. 8, in the present embodiment, the low-friction sheet 22 comprises a generally rectangular piece extending in the longitudinal direction X, which has a pair of opposed, longitudinal edges thereof overlapping each other as the low-friction sheet 22 wraps around the stationary pad 26. The low-friction sheet 22 has one or more (e.g., in this case, five) pairs of screw holes 22*c* defined in the pair of opposed, longitudinal edges thereof, each paired screw holes being aligned with each other upon wrapping of the low-friction sheet 22 around the stationary pad 26.

Also, as mentioned earlier, one or more perforations 22*a* and 22*b* are defined in the low-friction sheet 22 through which the contact portions 26*a* and 26*b* are inserted to allow close fitting between the low-friction sheet 22 and the stationary fuser pad 26 except at the contact portions 26*a* and 26*b*. For example, two series of eight oval perforations 22*a* and 22*b* may be provided, each perforation adapted to accommodate a single protrusion included in the pair of contact portions 26*a* and 26*b* of the fuser pad 26.

Figure 9:
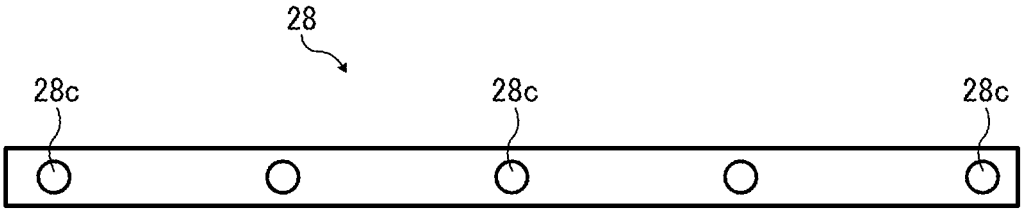
FIG. 9 is a plan view of a securing plate before assembly into the fixing device of FIG. 2.

FIG. 9 is a plan view of the securing plate 28 before assembly into the fixing device 20 of FIG. 2.

As shown in FIG. 9, in the present embodiment, the securing plate 28 is a flat, elongated piece of suitable material having a length comparable to that of the fuser pad 26. The securing plate 28 has one or more (e.g., in this case, five) screw holes 28*c* defined therein to allow insertion of screws 24 therethrough.

Figure 10A:
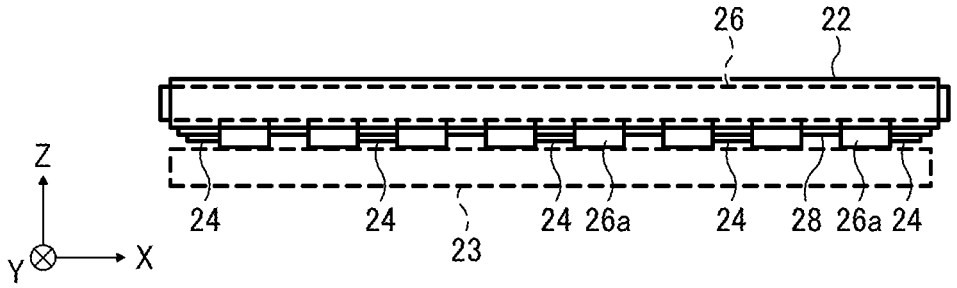
FIGS. 10A and 10B are side-elevation and plan views, respectively, of the stationary fuser pad assembled together with the low-friction sheet and the securing plate.
Figure 10B:
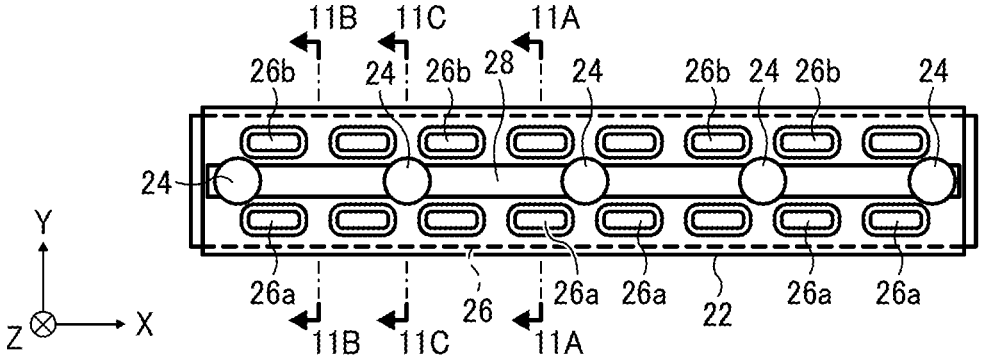

FIGS. 10A and 10B are side-elevation and plan views, respectively, of the stationary fuser pad 26 assembled together with the low-friction sheet 22 and the securing plate 28.

As shown in FIGS. 10A and 10B, in the present embodiment, one or more (e.g., in this case, five) screws 24 are provided for fastening the low-friction sheet 22 onto the stationary pad 26, each screw 24 evenly spaced apart from each other in the longitudinal direction X of the fuser pad 26. To accommodate these screws 24, the same number of screw holes may be provided at corresponding locations along each of the longitudinal edge of the low-friction sheet 22 and the securing plate 28. Also, the same number of female threads 26*c* may be provided in the fuser pad 26, each adapted for engagement with a threaded end of the screw 24 (see FIG. 7B, for example).

Upon assembly, each of the one or more screws 24 passes through the aligned screw holes of the low-friction sheet 22 into the stationary pad 26 to fasten the sheet 22 onto the stationary pad 26. The securing plate 28 is disposed over the overlapping edges of the low-friction sheet 22, and screwed onto the fuser pad 26 together with the sheet 22 to secure the sheet 22 in place on the fuser pad 26.

The fuser pad 26, the low-friction sheet 22, the securing plate 28, and the screws 24 are thus combined together to form a single, integrated subassembly module for mounting to the fixing device 20.

Figure 11A:
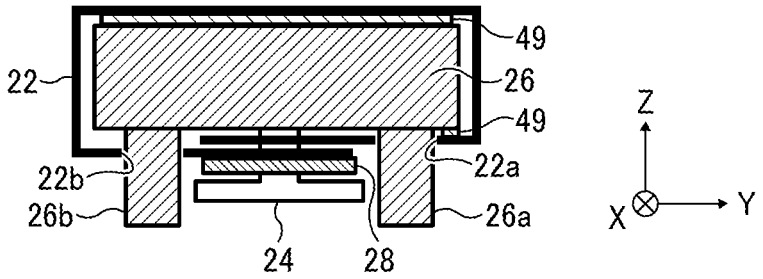
FIGS. 11A, 11B, and 11C are cross-sectional views along lines 11A-11A, 11B-11B, and 11C-11C, respectively, of FIG. 10B.
Figure 11B:
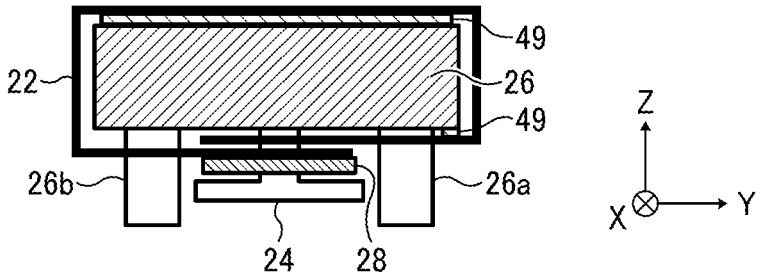
Figure 11C:
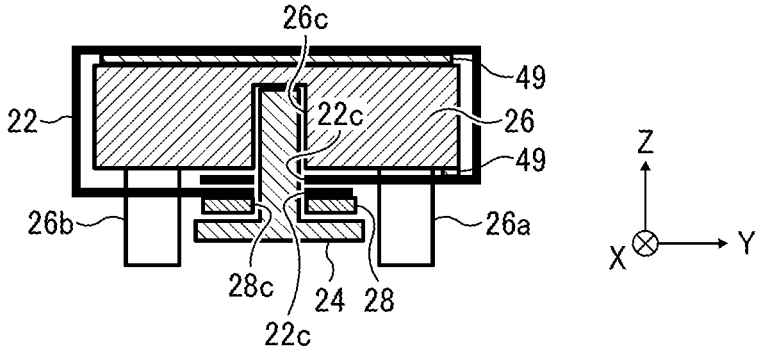

FIGS. 11A, 11B, and 11C are cross-sectional views along lines 11A-11A, 11B-11B, and 11C-11C, respectively, of FIG. 10B.

As shown in FIGS. 11A through 11C, in the fuser assembly, the low-friction sheet 22 wraps around the fuser pad 26 except for the contact portions 26*a* and 26*b* protruding through the perforations 22*a* and 22*b* defined in the sheet 22 (FIG. 11A).

The pair of opposed longitudinal edges of the low-friction sheet 22 overlaps each other at a position between the upstream and downstream contact portions 26*a* and 26*b*, with the securing plate 28 disposed over the overlapping edges of the sheet 22 (FIG. 11B).

The screw 24 is inserted through the screw hole 28*c* of the securing plate 28 and the paired screw holes 22*c* of the low-friction sheet 22, to engage the female thread 26*c* defined in the fuser pad 26 (FIG. 11C). For preventing interference between the screw 24 and the reinforcing member 23, the screw head is suitably sized or positioned so as not to protrude beyond the contact portions 26*a* and 26*b* in the load direction Z.

Thus, the low-friction sheet 22 has its opposed longitudinal edges, one directed upstream and the other downstream in the conveyance direction Y, both fastened onto the fuser pad 26 with the screws 24. Such arrangement effectively protects the sheet 22 against displacement or separation from the fuser pad 26 as well as creasing and other deformation from its proper configuration due to frictional contact with the fuser belt 21, which would otherwise occur, for example, where the fuser belt 21 moves from upstream to downstream in the rotational direction during normal operation of the fixing device 20, or where the fuser belt 21 moves from downstream to upstream in the rotational direction as the fuser member and/or the pressure member are manually rotated during maintenance or repair, such as removal of a paper jam, of the fixing device 20.

Moreover, using the evenly spaced screws 24 in combination with the securing plate 28 disposed on the overlapping edges of the sheet 22 can fasten the low-friction sheet 22 onto the fuser pad 26 more stably and firmly than other types of fastening mechanism, such as bonding the overlapping edges together using adhesive, or hooking the overlapping edges onto the contact portions.

Further, perforating the low-friction sheet 22 for accommodating the contact portions 26*a* and 26*b* while positioning the screws 24 and the securing plate 28 between the contact portions 26*a* and 26*b* allows for a compact overall size of the fuser assembly.

Still further, integratability of the fuser pad 26 together with the low-friction sheet 22 and the associated fastener and securing mechanism into an integrated subassembly module allows for good controllability and efficient assembly during manufacture and maintenance of the fixing device 20.

Furthermore, evenly spacing the series of protrusions constituting the contact portion of the fuser pad 26 translates into even distribution of forces acting on the perforations 22*a* and 22*b* of the low-friction sheet 22, which prevents the sheet 22 from damage due to concentrated stress as the sheet 22 slides against adjoining surfaces during operation.

Referring back to FIG. 2, the rotatable pressure member 31 is shown comprising a motor-driven, elastically biased cylindrical roller formed of a hollow core 32 of metal, covered with an elastic layer 33 of thermally insulating material, such as sponged or solid silicone rubber, fluorine rubber, or the like. An additional, thin outer layer of release agent, such as PFA, PTFE, or the like, may be deposited over the elastic layer 33. Optionally, the pressure roller 31 may have a dedicated heater, such as a halogen heater, accommodated in the hollow interior of the metal core 32.

With the pressure roller 31 formed with the elastic layer 33, the fuser pad 26 is effectively protected against overload as the elastic material absorbs extra pressure applied to the fuser pad 26 from the pressure roller 31. In addition, forming the elastic layer 33 of thermally insulative material reduces heat conduction from the fuser belt 21 toward the pressure roller 31, leading to high thermal efficiency in heating the fuser belt 21.

In the present embodiment, the pressure roller 31 has a diameter of approximately 25 mm, which is comparable to that of the fuser belt 21 in its looped, generally cylindrical configuration. Although the fuser belt 21 and the pressure roller 31 are of a similar diameter in the present embodiment, instead, it is possible to provide the generally cylindrical fixing members 21 and 31 with different diameters. For example, it is possible to form the fuser belt 21 with a diameter smaller than that of the pressure roller 31, so that the fuser belt 21 exhibits a greater curvature than that of the pressure roller 31 at the fixing nip N, which effects good stripping of a recording sheet from the fuser belt 21 upon exiting the fixing nip N.

The pressure roller 31 has its opposed longitudinal ends rotatably supported on the sidewalls 43 of the fixing device 20 via a pair of bearings 42. A gear 45 is provided to one longitudinal end of the pressure roller 31, which engages a gear or gear train of a suitable rotary drive motor to impart torque to the pressure roller 31.

Additionally, a releasable biasing mechanism may be operatively connected with the pressure roller 31, which allows movement of the pressure roller 31 relative to the fuser belt 21 to vary the pressure between the pressure roller 31 and the belt 21. The releasable biasing mechanism may be used to release nip pressure between the pressure roller 31 and the fuser belt 21 in various occasions. A suitable controller may be provided to control operation of the mechanism using a suitable actuator.

For example, where the fixing device 20 remains inactive, the pressure roller 31 may be moved into the unloaded position to prevent deformation of the fuser belt 21 and the pressure roller 31, which would occur where the fixing members are continuously subjected to a substantial nip pressure for an extended period of non-operation. Further, where a paper jam occurs at the fixing nip N, the pressure roller 31 may be unloaded either manually or automatically through the releasable biasing mechanism, as to facilitate removal of the jammed paper from between the fuser belt 21 and the pressure roller 31.

The second temperature sensor 41 comprises a suitable thermometer, such as a thermistor, disposed in contact with the circumferential surface of the pressure roller 31.

Readings of the second temperature sensor 41 may be used to control operation of the fixing device 20 and its associated imaging processes. For example, printing may be suspended where the temperature sensor 41 detects a surface temperature of the pressure roller 31 falling below a predetermined temperature limit. Further, in a configuration in which the pressure roller 31 has a dedicated heater, operation of the heater may be electrically controlled, for example, through on-off control based on readings of the second temperature sensor 41.

With further reference to FIGS. 2, 3A and 3B, the fixing device 20 is shown with the heat conductive member 50 interposed between the belt 21 and the heater 25 and facing at least partially the outboard portion L of the belt 21 to transfer heat radiated from the heater 25 by conduction therethrough to the belt 21.

Specifically, in the present embodiment, two heat conductive members 50 are provided, one for each of the opposed outboard portions L of the belt 21, each comprising an arched strip of heat conductive material extending generally along a circumferential direction of the belt 21.

For example, the heat conductive member 50 may be a strip of metal such as nickel approximately 40 μm thick, bent into an arched, semi-cylindrical shape corresponding to the generally cylindrical configuration of the belt 21. The heat conductive member 50 may be supported, for example, on the sidewall 43 of the fixing device 20.

The heat conductive member 50 covers at least a part of the outboard portion L of the belt 21 from direct radiation from the heater 25. Thus, a certain amount of radiation directed from the stationary heaters 25A and 25B, in particular, that from the second heater 25B reaches the heat conductive member 50 instead of the belt 21. That part of the outboard portion L of the belt 21 covered by the heat conductive member 50 is not directly heated by radiation from the stationary heaters 25A and 25B but instead may be heated with heat flowing from the heat conductive member 50.

The inventors have recognized that one problem associated with the belt-based fixing device is inefficient, non-uniform heating of the belt, which has its inboard portion (i.e., that portion around the longitudinal center of the belt adapted to contact the recording medium during passage through the fixing nip) and its outboard portion (i.e., that portion around the longitudinal end of the belt adapted to remain away from the recording medium during passage through the fixing nip) subjected to different amounts of heat upon activation of the fixing device.

For example, the outboard portion of the belt can be excessively heated after startup of the fixing device, for example, where the belt is warmed stably and sufficiently to a desired operational temperature during sequential processing of multiple recording media. Compared to the inboard portion from which heat escapes toward the recording medium or elsewhere to participate in the fixing process, the outboard portion of the belt tends to accumulate greater amounts of heat as there is substantially no constant flow of heat from the outboard portion to surrounding structures. Excessive heating of the outboard portion, if not corrected, would result in thermal damage to the belt and concomitant failure of the fixing device.

To counteract the problem, a conceivable approach is to employ a heat shield interposed between the heater and the belt and facing the outboard portion of the belt to intercept transmission of heat from the heater to the belt.

Although generally successful for its intended purpose, this approach also has a drawback. That is, with the heat shield facing the outboard portion of the belt, heat can escape from the laterally outward, peripheral part of the inboard portion to the outboard portion of the belt during startup of the fixing device, for example, initially in the morning, where the belt has been cooled to an ambient temperature due to an extended period of deactivation. Uneven distribution of heat across the inboard portion of the belt, if not corrected, would adversely affect good imaging quality of the fixing device.

To address these and other problems, the fixing device 20 according to this patent specification is provided with a capability to change a rate of heat transfer from the heat conductive member 50 to the belt 21.

For example, the fixing device 20 may increase the rate of heat transfer from the heat conductive member 50 to the belt 21 during startup of the fixing device 20 (i.e., for a certain duration of time since the fixing device 20 is powered on, for example, initially in the morning, where the belt 21 has been cooled to an ambient temperature due to an extended period of deactivation).

Increasing the rate of heat transfer from the heat conductive member 50 to the belt 21 during startup of the fixing device 20 prevents uneven distribution of heat across the inboard portion M of the belt 21 due to heat escaping from the laterally outward, peripheral part of the inboard portion M to the outboard portion L of the belt 21, which would otherwise adversely affect good imaging quality of the fixing device 20.

Further, the fixing device 20 may decrease the rate of heat transfer from the heat conductive member 50 to the belt 21 after startup of the fixing device 20 (i.e., after a certain duration of time has elapsed since power-on of the fixing device 20, for example, where the belt 21 is warmed stably and sufficiently to a desired operational temperature during sequential processing of multiple recording media).

Decreasing the rate of heat transfer from the heat conductive member 50 to the belt 21 after startup of the fixing device 20 reliably prevents excessive heating of the outboard portion L of the belt 21 due to a substantial lack of constant flow of heat from the outboard portion L to surrounding structures, which would otherwise result in thermal damage to the belt 21 and concomitant failure of the fixing device 20.

The heat transfer rate changing capability of the fixing device 20 may be accomplished, for example, by displacing at least one of the belt 21 and the heat conductive member 50 relative to each other in a radial direction of the belt 21.

Specifically, in the present embodiment, each of the belt 21 and the heat conductive member 50 is displaced due to thermal expansion outward in the radial direction upon activation of the fixing device 20. The heat conductive member 50 is heated to cause thermal expansion earlier than the belt 21 upon activation of the fixing device 20. The heat conductive member 50 exhibits a thermal expansion coefficient smaller than that of the belt 21.

For example, the heat conductive member 50 may be placed closer to the heater 25 than the belt 21 in the radial direction of the belt 21. As radiation from the heater 25 heats the heat conductive member 50 before heat from the heater 25 and the heat conductive member 50 heats the outboard portion L of belt 21, the heat conductive member 50 thermally expands earlier than the belt 21 upon activation of the fixing device 20. The heat conductive member 50 may be formed of nickel, which exhibits a smaller thermal expansion coefficient than the belt 21 formed of an elastic material on a resin or metal substrate.

Further, in the present embodiment, an amount of displacement by which each of the belt 21 and the heat conductive member 50 is displaced outward from its original position in the radial direction is greater in the heat conductive member 50 than in the belt 21 during startup of the fixing device 20, and smaller in the heat conductive member 50 than in the belt 21 after startup of the fixing device 20.

The amount of displacement of the belt 21 and the heat conductive member 50 may be adjusted, for example, through appropriate positioning of the belt 21 and the heat conductive member 50 relative to the heater 25 inside the loop of the belt 21, and through appropriate selection of materials of which the belt 21 and the heat conductive member 50 are made.

In such a configuration, during startup of the fixing device 20, the greater amount of displacement experienced by the heat conductive member 50 than the belt 21 causes the heat conductive member 50 to approach the belt 21, resulting in an increased contact pressure or decreased distance between the heat conductive member 50 and the belt 21, which eventually increases the rate of heat transfer from the heat conductive member 50 to the belt 21.

Conversely, after startup of the fixing device 20, the smaller amount of displacement experienced by the heat conductive member 50 than the belt 21 causes the heat conductive member 50 to move away from the belt 21, resulting in a decreased contact pressure or increased distance between the heat conductive member 50 and the belt 21, which eventually decreases the rate of heat transfer from the heat conductive member 50 to the belt 21.

Hence, in the present embodiment, the fixing device 20 changes the rate of heat transfer from the heat conductive member 50 to the belt 21 based on relative displacement of the belt 21 and the heat conductive member 50 due to thermal expansion in the radial direction. Compared to a configuration in which a separate positioning mechanism is used to vary relative positions of the belt and the heat conductive member, such arrangement allows for an inexpensive, compact configuration of the fixing device 20.

Several specific examples of the fixing device 20 with the heat transfer rate changing capability are described hereinbelow, with reference to FIGS. 12A and 12B and subsequent drawings.

Figure 12A:
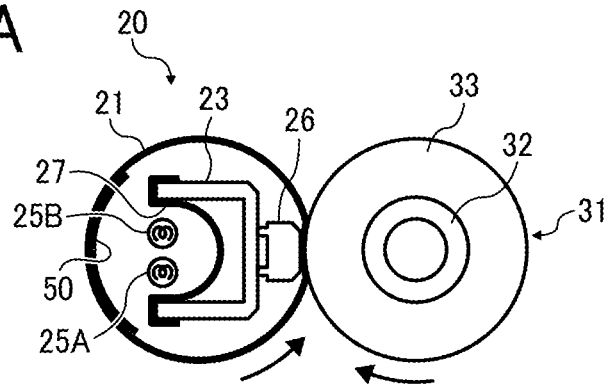
FIGS. 12A and 12B are end-on, axial views of the fixing device incorporating a heat transfer rate changing capability according to one embodiment of this patent specification.
Figure 12B:
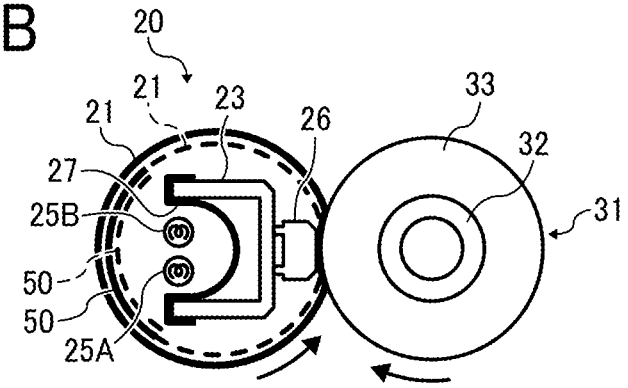

FIGS. 12A and 12B are end-on, axial views of the fixing device 20 incorporating the heat transfer rate changing capability according to one embodiment of this patent specification.

As shown in FIGS. 12A and 12B, the heat conductive member 50 contacts the belt 21 before activation of the fixing device 20 (FIG. 12A), remains in contact with the belt 21 during startup of the fixing device 20 (FIG. 12A), and separates from the belt 21 after startup of the fixing device 20 (FIG. 12B).

Specifically, before activation of the fixing device 20, the heat conductive member 50 may contact the belt 21 with a suitable contact pressure of approximately 0.1 kg/cm$^2$, for example, where the fixing device 20 remains deactivated under normal environmental conditions, such as a temperature of 25° C. and a humidity of 50%.

As the fixing device 20 undergoes startup, radiation from the heaters 25A and 25B, in particular, that from the second heater 25B heats the heat conductive member 50 before heat from the heater 25 and the heat conductive member 50 heats the outboard portion L of belt 21. The heat conductive member 50, thus heated prior to the outboard portion L of the belt 21, expands outward in the radial direction by an amount greater than that of the outboard portion L of the belt 21. As a result, the heat conductive member 50 and the belt 21 remain in contact with each other, with the contact pressure increased from the initial value of approximately 0.1 kg/cm$^2$.

The increase in contact pressure between the heat conductive member 50 and the belt 21 promotes efficient heat transfer from the heat conductive member 50 to the belt 21, causing the lateral end of the belt 21 to be heated to a temperature comparable to those portions of the belt 21 exposed to direct radiation from the heaters 25A and 25B, resulting in generally uniform temperatures at the inboard portion M and the outboard portion L of the belt 21.

Such arrangement prevents uneven distribution of heat across the inboard portion M of the belt 21 due to heat escaping from the laterally outward, peripheral part of the inboard portion M to the outboard portion L of the belt 21 during startup of the fixing device 20, which would otherwise result in concomitant adverse effects on imaging quality of the fixing device 20.

Then, as the fixing device 20 completes startup, the outboard portion L of the belt 21, which has been heated with heat flowing from the heat conductive member 50, expands outward in the radial direction by an amount greater than that of the heat conductive member 50. As a result, the heat conductive member 50 and the belt 21 separate from each other with a suitable spacing created therebetween.

The separation of the belt 21 from the heat conductive member 50 hinders further heat transfer from the heat conductive member 50 to the belt 21, while the heat conductive member 50 intercepts radiation from the heaters 25A and 25B to the lateral end of the belt 21.

Such arrangement reliably prevents excessive heating of the outboard portion L of the belt 21 due to a substantial lack of constant flow of heat from the outboard portion L to surrounding structures, which would otherwise result in thermal damage to the belt 21 and concomitant failure of the fixing device 20.

It is to be noted that the heat transfer rate changing capability based on relative displacement of the belt 21 and the heat conductive member 50 may be accomplished otherwise than described herein.

For example, in further embodiment, the heat conductive member 50 may contact the belt 21 with a predetermined, initial contact pressure before activation of the fixing device 20, as is the case with the foregoing embodiment.

In such cases, the belt 21 and the heat conductive member 50 may be displaced relative to each other such that the contact pressure between the heat conductive member 50 and the belt 21 is equal to or higher than the initial contact pressure during startup of the fixing device 20, and lower than the initial contact pressure after startup of the fixing device 20.

In still further embodiment, the heat conductive member 50 may be spaced apart from the belt 21 by a predetermined, initial distance in the radial direction before activation of the fixing device 20, unlike the foregoing embodiment.

In such cases, the belt 21 and the heat conductive member 50 may be displaced relative to each other such that the distance between the heat conductive member 50 and the belt 21 is equal to or shorter than the initial distance during startup of the fixing device 20, and longer than the initial distance after startup of the fixing device 20.

With continued reference to FIGS. 3A and 3B, the heat conductive member 50 is shown having its one edge displaced laterally outward from an adjacent edge of the inboard portion M of the belt 21 and another, opposite edge aligned with an adjacent edge of the outboard portion L of the belt 21.

Specifically, in the present embodiment, an offset or spacing R may be provided between the adjacent edges of the heat conductive strip 50 and the inboard portion M of the belt 21. For example, the offset R may be set to a sufficiently short length of approximately 2 mm in the longitudinal direction X.

Provision of the offset R causes a part of the outboard portion L contiguous with the inboard portion M of the belt 21 to be exposed to direct radiation from the heater 25, thereby reliably preventing heat from escaping from the laterally outward, peripheral part of the inboard portion M to the outboard portion L of the belt 21. Setting the offset R to a sufficiently short length prevents undue heat to be imparted across the outboard portion L of the belt 21 and resultant thermal damage to the belt 21 upon activation of the fixing device 20.

It is to be noted that, although the heat conductive member 50 is described as facing only part of the outboard portion L of the belt 21 in the present embodiment, alternatively, instead, the heat conductive member 50 may be configured to face the entire outboard portion L of the belt 21.

Further, a lubricant may be disposed between the heat conductive member 50 and the belt 21 to lubricate where the heat conductive member 50 contacts the belt 21.

For example, a lubricating agent, such as silicone oil, fluorine grease, or the like, may be deposited on the outer circumferential surface of the heat conductive member 50 facing the inner circumferential surface of the belt 21. Alternatively, instead, a layer of solid lubricant, such as fluorine resin or the like, may be formed on the outer circumferential surface of the heat conductive member 50 facing the inner circumferential surface of the belt 21.

Provision of the lubricant between the heat conductive member 50 and the belt 21 reduces friction at their interfacial surfaces, even in the presence of a substantial contact pressure between the heat conductive member 50 and the belt 21 during startup of the fixing device 20.

Furthermore, the heat conductive member 50 may include a treated surface to promote radiant heat absorption where the heat conductive member 50 faces the heater 25.

For example, a black coating material may be disposed on the inner circumferential surface of the heat conductive member 50 facing the heater 25 to promote absorption of infrared radiation from the stationary heaters 25A and 25B, in particular, that from the second heater 25B.

Provision of surface treatment to promote heat absorption of the heat conductive member 50 in turn promotes heat transfer to the belt 21 through the heat conductive member 50, leading to more efficient heating of the belt 21 in the fixing device 20 than is otherwise possible.

Figure 13:
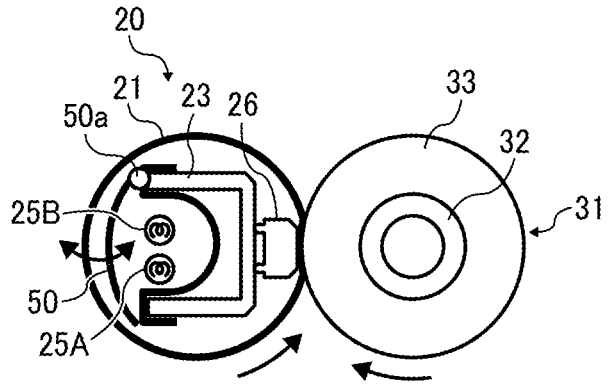
FIG. 13 is an end-on, axial view of the fixing device incorporating the heat transfer rate changing capability according to another embodiment of this patent specification.

FIG. 13 is an end-on, axial view of the fixing device 20 incorporating the heat transfer rate changing capability according to another embodiment of this patent specification.

As shown in FIG. 13, the overall configuration of the fixing device 20 is similar to that described in FIGS. 12A and 12B, except that the heat conductive member 50 has its one circumferential end hinged and another, opposite circumferential end free to allow displacement in the radial direction.

Specifically, in the present embodiment, one circumferential end of the heat conductive member 50 is connected to a hinge 50*a* provided on the distal edge 23*d* of one of the parallel upstanding walls 23*c* of the reinforcing member 23. The other circumferential end of the heat conductive member 50 is freely supported on the distal edge 23*d* of the other one of the parallel upstanding walls 23*c* of the reinforcing member 23.

As is the case with the foregoing embodiment, the heat conductive member 50 may contact the belt 21 before activation of the fixing device 20, remains in contact with the belt 21 during startup of the fixing device 20, and separates from the belt 21 after startup of the fixing device 20. Upon activation of the fixing device 20, the heat conductive member 50 may rotate around the hinge 50*a* while displaced due to thermal expansion or contraction in the radial direction of the belt 20.

Provision of the heat conductive member 50 with the hinged circumferential end allows for radial displacement of the heat conductive member 50 toward and away from the belt 21 without causing deformation to the surrounding structure, for example, the reinforcing member 23 on which the heat conductive member 50 is supported, even where the heat conductive member 50 is formed of a relatively thick material to obtain sufficient stiffness.

To recapitulate, the fixing device 20 according to several embodiments of this patent specification includes a rotatable, endless belt 21 looped into a generally cylindrical configuration; a stationary heater 25 disposed inside the loop of the belt 21 to radiate heat to the belt 21; a stationary pad 26 disposed inside the loop of the belt 21; a rotatable pressure member 31 disposed parallel to the stationary pad 26 with the belt 21 interposed between the pressure member 31 and the stationary pad 26.

The pressure member 31 presses against the stationary pad 26 via the belt 21 to form a fixing nip N therebetween through which a recording medium P passes. The belt 21 has an inboard portion M thereof adapted to contact the recording medium P during passage through the fixing nip N, and an outboard portion L thereof adapted to remain away from the recording medium P during passage through the fixing nip N.

The fixing device 20 also includes a heat conductive member 50 interposed between the belt 21 and the heater 25 and facing at least partially the outboard portion L of the belt 21 to transfer heat radiated from the heater 25 by conduction therethrough to the belt 21. At least one of the belt 21 and the heat conductive member 50 is displaceable relative to each other in a radial direction of the belt 21 to change a rate of heat transfer from the heat conductive member 50 to the belt 21.

The fixing device 20 provides a fast, reliable fixing process with an extremely short warm-up time and first-print time, owing to its capability to change a rate of heat transfer from the heat conductive member 50 to the belt 21, which prevents uneven distribution of heat across the inboard portion M of the belt 21 due to heat escaping from the laterally outward, peripheral part of the inboard portion M to the outboard portion L of the belt 21, while reliably preventing excessive heating of the outboard portion L of the belt 21 due to a substantial lack of constant flow of heat from the outboard portion L to surrounding structures, leading to efficient, uniform heating of the belt 21.

Although a particular configuration has been illustrated, the fixing device 20 may be configured otherwise than that depicted herein, with appropriate modifications to the material, number, size, shape, position, and other features of components included in the fixing device 20.

For example, instead of a multilayered belt, the belt 21 may be configured as a thin film of material, such as polyimide, polyamide, fluorine rubber, metal, or the like, formed into an endless looped configuration. Further, instead of a cylindrical roller, the pressure member 31 may be configured as an endless belt loped into a generally cylindrical configuration.

In each of those alternative embodiments, various beneficial effects may be obtained from the guide mechanism for the pressure member and other aspects of the fixing device 20 according to this patent specification.

Numerous additional modifications and variations are possible in light of the above teachings. It is therefore to be understood that, within the scope of the appended claims, the disclosure of this patent specification may be practiced otherwise than as specifically described herein.

What is claimed is:

1. A fixing device comprising:

a rotatable endless belt looped into a generally cylindrical configuration;

a stationary heater being inside the loop of the belt to radiate heat to the belt;

a stationary pad being inside the loop of the belt;

a rotatable pressure member disposed parallel to the stationary pad with the belt interposed between the pressure member and the stationary pad, the pressure member pressing against the stationary pad via the belt to form a fixing nip therebetween through which a recording medium passes, the belt having an inboard portion thereof adapted to contact the recording medium during passage through the fixing nip, and an outboard portion thereof adapted to remain away from the recording medium during passage through the fixing nip; and a heat conductive member interposed between the belt and the heater and facing less than an entire portion of the outboard portion of the belt to transfer heat radiated from the heater by conduction therethrough to the belt, wherein at least one of the belt and the heat conductive member is displaceable relative to each other in a radial direction of the belt to change a rate of heat transfer from the heat conductive member to the belt, and wherein the heat conductive member contacts the belt before activation of the fixing device, remains in contact with the belt during startup of the fixing device, and separates from the belt after startup of the fixing device.

2. The fixing device according to claim 1, wherein each of the belt and the heat conductive member is displaced due to thermal expansion outward in the radial direction upon activation of the fixing device.

3. The fixing device according to claim 2, wherein the heat conductive member exhibits a thermal expansion coefficient smaller than that of the belt.

4. The fixing device according to claim 2, wherein the heat conductive member is heated to cause thermal expansion earlier than the belt upon activation of the fixing device.

5. The fixing device according to claim 2, wherein an amount of displacement by which each of the belt and the heat conductive member is displaced outward from its original position in the radial direction is greater in the heat conductive member than in the belt during startup of the fixing device, and smaller in the heat conductive member than in the belt after startup of the fixing device.

6. The fixing device according to claim 1, wherein the heat conductive member comprises an arched strip of heat conductive material extending generally along a circumferential direction of the belt.

7. The fixing device according to claim 6, wherein the heat conductive member has its one edge displaced laterally outward from an adjacent edge of the inboard portion of the belt and another, opposite edge aligned with an adjacent edge of the outboard portion of the belt.

8. The fixing device according to claim 6, wherein the heat conductive member has its one circumferential end hinged and another, opposite circumferential end free to allow displacement in the radial direction.

9. The fixing device according to claim 1, further comprising:

a lubricant disposed between the heat conductive member and the belt to lubricate where the heat conductive member contacts the belt.

10. The fixing device according to claim 1, wherein the heat conductive member includes a treated surface to promote radiant heat absorption where the heat conductive member faces the heater.

11. The fixing device according to claim 1, further comprising:

a stationary reinforcing member disposed in contact with the stationary pad inside the loop of the belt to reinforce the stationary pad against pressure from the pressure member; and a reflector interposed between the heater and the reinforcing member to reflect radiation from the heater, wherein the reinforcing member comprises a rectangular U-shaped beam having a central wall to contact the stationary pad, and a pair of opposed parallel upstanding walls each extending from the central wall to form a space therebetween in which the heater is accommodated while isolated from the reinforcing member by the reflector.

12. The fixing device according to claim 1, further comprising:

a pair of mounting flanges connected to a pair of opposed lateral ends of the belt to retain the belt in shape.

13. An image forming apparatus incorporating the fixing device according to claim 1.

14. A fixing device comprising:

a rotatable endless belt looped into a generally cylindrical configuration;

a stationary heater being inside the loop of the belt to radiate heat to the belt;

a stationary pad being inside the loop of the belt;

a rotatable pressure member disposed parallel to the stationary pad with the belt interposed between the pressure member and the stationary pad, the pressure member pressing against the stationary pad via the belt to form a fixing nip therebetween through which a recording medium passes, the belt having an inboard portion thereof adapted to contact the recording medium during passage through the fixing nip, and an outboard portion thereof adapted to remain away from the recording medium during passage through the fixing nip; and a heat conductive member interposed between the belt and the heater and facing less than an entire portion of the outboard portion of the belt to transfer heat radiated from the heater by conduction therethrough to the belt, wherein at least one of the belt and the heat conductive member is displaceable relative to each other in a radial direction of the belt to change a rate of heat transfer from the heat conductive member to the belt, and wherein the heat conductive member contacts the belt with a set initial contact pressure before activation of the fixing device, the contact pressure between the heat conductive member and the belt being equal to or higher than the initial contact pressure during startup of the fixing device, and lower than the initial contact pressure after startup of the fixing device.

15. An image forming apparatus incorporating the fixing device according to claim 14.

16. The fixing device according to claim 14 wherein each of the belt and the heat conductive member is displaced due to thermal expansion outward in the radial direction upon activation of the fixing device.

17. A fixing device comprising:

a rotatable endless belt looped into a generally cylindrical configuration;

a stationary heater being inside the loop of the belt to radiate heat to the belt;

a stationary pad being inside the loop of the belt;

a rotatable pressure member disposed parallel to the stationary pad with the belt interposed between the pressure member and the stationary pad, the pressure member pressing against the stationary pad via the belt to form a fixing nip therebetween through which a recording medium passes, the belt having an inboard portion thereof adapted to contact the recording medium during passage through the fixing nip, and an outboard portion thereof adapted to remain away from the recording medium during passage through the fixing nip; and a heat conductive member interposed between the belt and the heater and facing less than an entire portion of the outboard portion of the belt to transfer heat radiated from the heater by conduction therethrough to the belt, wherein at least one of the belt and the heat conductive member is displaceable relative to each other in a radial direction of the belt to change a rate of heat transfer from the heat conductive member to the belt, and wherein the heat conductive member is spaced apart from the belt by a set initial distance in the radial direction before activation of the fixing device, the distance between the heat conductive member and the belt being equal to or shorter than the initial distance during startup of the fixing device, and longer than the initial distance after startup of the fixing device.

18. An image forming apparatus incorporating the fixing device according to claim 17.

19. The fixing device according to claim 17, wherein each of the belt and the heat conductive member is displaced due to thermal expansion outward in the radial direction upon activation of the fixing device.

* * * * *